US011045927B2

(12) United States Patent
Kane et al.

(10) Patent No.: US 11,045,927 B2
(45) Date of Patent: Jun. 29, 2021

(54) ADJUSTABLE FASTENER TOOLS FOR ENGAGING SOCKET HEADS

(71) Applicant: INTERNATIONAL BUSINESS MACHINES CORPORATION, Armonk, NY (US)

(72) Inventors: Michael Kane, Hopewell Junction, NY (US); Colin E. Masterson, Rochester, MN (US); Suraush Khambati, Poughkeepsie, NY (US); Marie Cole, Wappingers Falls, NY (US); Jacob T. Porter, Highland, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 211 days.

(21) Appl. No.: 15/975,988

(22) Filed: May 10, 2018

(65) Prior Publication Data

US 2019/0344408 A1 Nov. 14, 2019

(51) Int. Cl.
*B25B 23/00* (2006.01)
*B25B 15/00* (2006.01)

(52) U.S. Cl.
CPC ..... *B25B 23/0007* (2013.01); *B25B 15/008* (2013.01)

(58) Field of Classification Search
CPC ... B25B 23/0007; B25B 15/008; B25B 13/18; B25B 13/44; B25B 13/12
USPC ..... 81/52, 90.1–91.3, 128
See application file for complete search history.

(56) References Cited

U.S. PATENT DOCUMENTS 468,241 A * 2/1892 Douglas ..... B25B 13/44 81/128
1,188,918 A * 6/1916 Dunlap ..... B25B 13/44 81/128
1,279,950 A * 9/1918 Wenzel ..... B25B 13/44 81/113

(Continued)

FOREIGN PATENT DOCUMENTS

GB 2 248 415 A 4/1992
WO WO 2017/015754 A1 2/2017

*Primary Examiner* — Hadi Shakeri
(74) *Attorney, Agent, or Firm* — Teddi Maranzano, Esq.; Kevin P. Radigan, Esq.; Heslin Rothenberg Farley & Mesiti P.C.

(57) ABSTRACT

Adjustable fastener tools are provided for engaging socket heads. The tool includes a support member, multiple engagement fingers, and an adjustment mechanism. The support member has multiple radially-extending tracks, and a central opening, and the fingers are associated with, and slidable along, the radially-extending tracks. The fingers include at radially inner ends jaws with respective contact surfaces for engaging the socket head. The adjustment mechanism resides, at least in part, within the central opening in the support member, and couples to the fingers. The adjustment mechanism includes an actuating member and multiple hinged trusses. A hinged truss of the trusses is hingedly coupled at one end to the actuating member and hingedly coupled at an other end to a respective finger of the engagement fingers. Movement of the actuating member results, via the hinged truss, in slidable movement of the respective finger along its associated radially-extending track.

20 Claims, 8 Drawing Sheets

(56) References Cited

U.S. PATENT DOCUMENTS

| | | | | |
|---|---|---|---|---|
| 1,760,338 | A * | 5/1930 | Billmyer, Jr. | B25B 13/44 81/113 |
| 3,665,791 | A | 5/1972 | Carr | |
| 4,911,040 | A * | 3/1990 | Kim | B25B 13/44 279/69 |
| 2,360,054 | A | 10/1994 | Haas | |
| 6,341,544 | B1 | 1/2002 | Falzone | |
| 6,622,598 | B2 * | 9/2003 | Chang | B25B 13/44 81/125 |
| 7,150,209 | B1 | 12/2006 | Loomis et al. | |
| 7,174,811 | B2 | 2/2007 | Wright | |
| 7,389,713 | B1 | 6/2008 | Chen | |
| 7,748,298 | B2 | 7/2010 | Brown | |
| 8,371,191 | B2 | 2/2013 | Huang | |
| 8,601,912 | B2 | 12/2013 | Huang et al. | |
| 9,308,629 | B2 | 4/2016 | Gadd et al. | |
| 2013/0074657 | A1 | 3/2013 | Bishop | |
| 2014/0109730 | A1 | 4/2014 | Pelletier et al. | |
| 2015/0343615 | A1 | 12/2015 | Merrick | |
| 2017/0291285 | A1 | 10/2017 | Merrick et al. | |

* cited by examiner

ADJUSTABLE FASTENER TOOLS FOR ENGAGING SOCKET HEADS

BACKGROUND

A variety of fasteners, such as bolts and screws, may be formed with socket heads, with a wide variety of socket head types being available. For instance, hex type sockets are widely used, as well as a variety of other types of sockets, including square or Robertson socket heads, double square socket heads, triple square socket heads, double hex socket heads, triangle-shaped or TA socket heads, etc. Most socket heads are provided in a range of sizes in both metric and SAE standards, creating a need for a wide variety of tools or adapters to engage the fasteners. Given the wide variety of socket head sizes currently in use for each socket head type, a large of number of tools are often required in order to address the different sizes of even a single type of socket head. For example, a hex key or wrench is a tool used to drive bolts and screws with hexagonal sockets or depressions formed in their heads. Presently, there is a one-to-one ratio used for each socket size to tool required. Thus, hex keys are typically produced in sets containing multiple sizes, and multiple sets may be required to fit a variety of different sizes in both SAE and metric standards.

SUMMARY

The shortcomings of the prior art are overcome and additional advantages are provided through the provision, in one or more aspects, of an adjustable fastener tool for engaging a socket head. The adjustable fastener tool includes a support member, multiple engagement fingers, and an adjustment mechanism. The support member includes a central opening and multiple radially-extending tracks, and the multiple engagement fingers are associated with, and slidable along, the multiple radially-extending tracks of the support member. The multiple engagement fingers include jaws at radially inner ends with respective contact surfaces for engaging the socket head. The adjustment mechanism resides, at least in part, within the central opening in the support member and is coupled to the multiple engagement fingers. The adjustment mechanism facilitates adjusting location of the multiple engagement fingers, including the jaws, along the multiple radially-extending tracks. The adjustment mechanism includes an actuating member and multiple hinged trusses. A hinged truss of the multiple hinged trusses is hingedly coupled at one end to the actuating member and hingedly coupled at an other end to a respective engagement finger of the multiple engagement fingers. Movement of the actuating member results, via the hinged truss, in slidable movement of the respective engagement finger along its associated radially-extending track.

In another aspect, an adjustable fastener tool is provided for engaging a socket head. The adjustable fastener tool includes a support member, multiple engagement fingers, an adjustment mechanism, and a drive mechanism. The support member includes a central opening and multiple radially-extending tracks, and the multiple engagement fingers are associated with, and slidable along, the multiple radially-extending tracks of the support member. The multiple engagement fingers include jaws at radially inner ends with respective contact surfaces for engaging the socket head. The adjustment mechanism resides, at least in part, within the central opening in the support member and is coupled to the multiple engagement fingers. The adjustment mechanism facilitates adjusting location of the multiple engagement fingers, including the jaws, along the multiple radially-extending tracks. The adjustment mechanism includes an actuating member and multiple hinged trusses. A hinged truss of the multiple hinged trusses is hingedly coupled at one end to the actuating member and hingedly coupled at an other end to a respective engagement finger of the multiple engagement fingers. Movement of the actuating member results, via the hinged truss, in slidable movement of the respective finger along its associated radially-extending track. The drive mechanism is coupled to the support member for imparting a force to the adjustable fastener tool when engaging the socket head.

In a further aspect, a method of fabricating an adjustable fastener tool is provided for engaging a socket head. The method includes providing a support member with a central opening and multiple radially-extending tracks, and providing multiple engagement fingers. The multiple engagement fingers are associated with, and slidable along, the multiple radially-extending tracks of the support member. The multiple engagement fingers include at radially inner ends thereof jaws with respective contact surfaces for engaging the socket head. The method further includes providing an adjustment mechanism residing, at least in part, within the central opening in the support member, and coupled to the multiple engagement fingers. The adjustment mechanism facilitates adjusting location of the multiple engagement fingers, including the jaws, along the multiple radially-extending tracks. The adjustment mechanism includes an actuating member, and multiple hinged trusses. A hinged truss of the multiple hinged trusses is hingedly coupled at one end to the actuating member, and hingedly coupled at an other end to a respective finger of the multiple engagement fingers. Movement of the actuating member results, via the hinged truss, in slidable movement of the respective engagement finger along its associated radially-extending track.

Additional features and advantages are realized through the techniques of the present invention. Other embodiments and aspects of the invention are described in detail herein and are considered a part of the claimed invention.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Aspects of the present invention and certain features, advantages and details thereof, are explained more fully below with reference to the non-limiting example(s) illustrated in the accompanying drawings. Descriptions of well-known materials, systems, devices, fabrication techniques, etc., are omitted so as to not unnecessarily obscure the invention in detail. It should be understood, however, that the detailed description and the specific example(s), while indicating aspects of the invention, are given by way of illustration only, and are not by way of limitation. Various substitutions, modifications, additions, and/or arrangements, within the spirit and/or scope of the underlying inventive concepts will be apparent to those skilled in the art from this disclosure. Note that reference is made below to the drawings, wherein the same or similar reference numbers used throughout different figures designate the same or similar components. Note further that numerous inventive aspects and features are disclosed herein, and unless inconsistent, each disclosed aspect or feature is combinable with any other disclosed aspect or feature as desired for a particular application, for instance, of an adjustable fastener tool for engaging a variety of differently-sized socket heads.

As noted, most socket heads are provided in a range of sizes in both metric and SAE standards, which has historically created a need for a wide variety of tool or adapter sizes to engage the different fasteners. Further, automation of manufacturing and service equipment continues to be a growing field. Tooling that allows for further automation of installation of differently-sized fasteners would have significant benefits in a manufacturing environment. Thus, to reduce the number of tools required and to further facilitate automation of various manufacturing processes, it is desirable to unify the conventional sets of tools for a particular type of socket head into a single variable or adjustable fastener tool.

Figure 4:
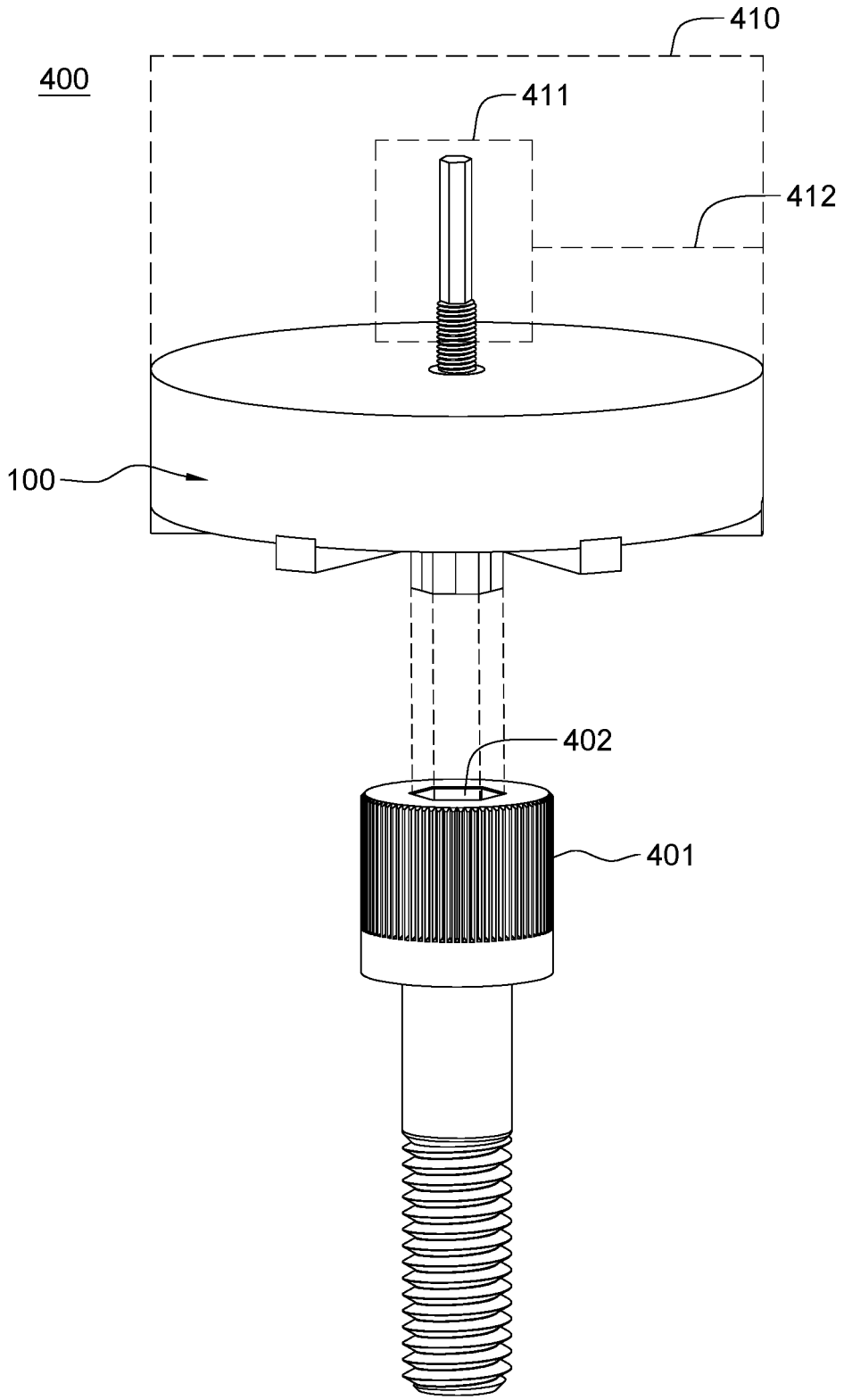
FIG. 4 depicts a further embodiment of an adjustable fastener tool to engage a socket head-type fastener, in accordance with one or more aspects of the present invention.
Figure 5:
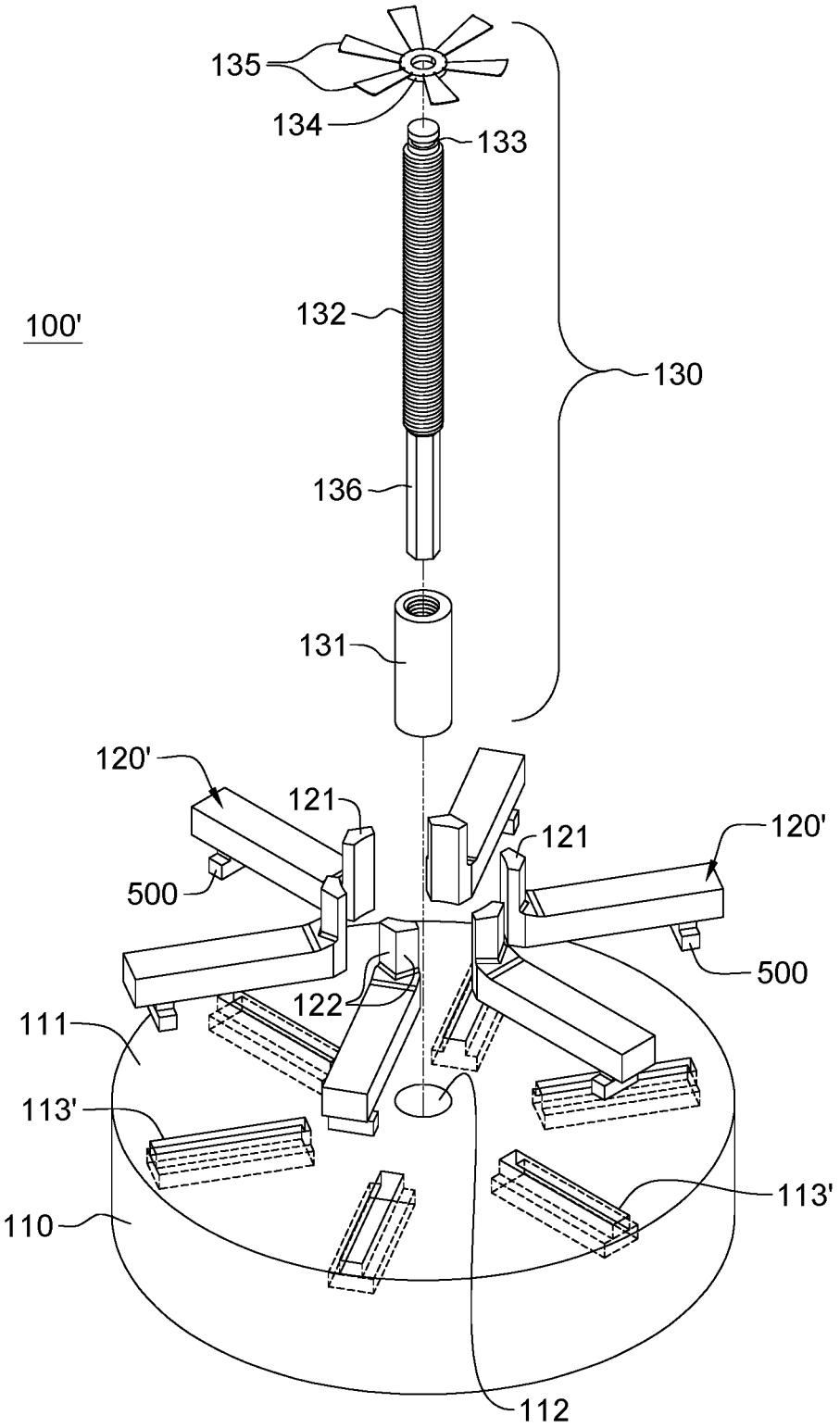
FIG. 5 depicts a partially exploded view of a further embodiment of an adjusted fastener tool, in accordance with one or more aspects of the present invention.
Figure 6:
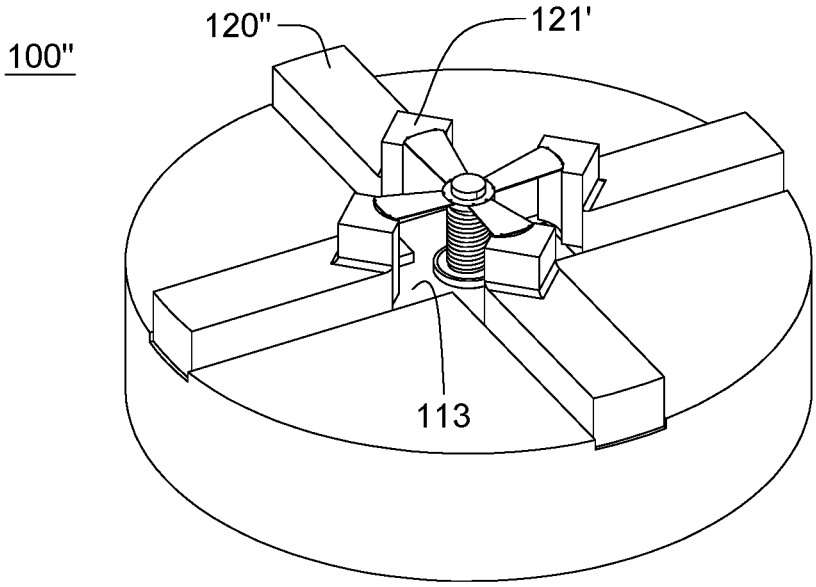
FIG. 6 depicts still another embodiment of an adjustable fastener tool, in accordance with one or more aspects of the present invention.

Addressing this, disclosed herein are embodiments of adjustable fastener tools for engaging or gripping various-sized socket heads of any particular socket type. For instance, an adjustable fastener tool is disclosed for engaging various-sized hex socket heads in both SAE and metric standards. Note that the particular hex-type fastener tool embodiment of FIGS. 1-5 is presented by way of example only. Those skilled in the art will understand from the description provided herein that other fastener tools may be readily configured for other types of socket heads using the aspects disclosed herein. For instance, FIG. 6 depicts one embodiment of a fastener tool for engaging various-sized square socket heads in both SAE and metric standards.

Figure 1:
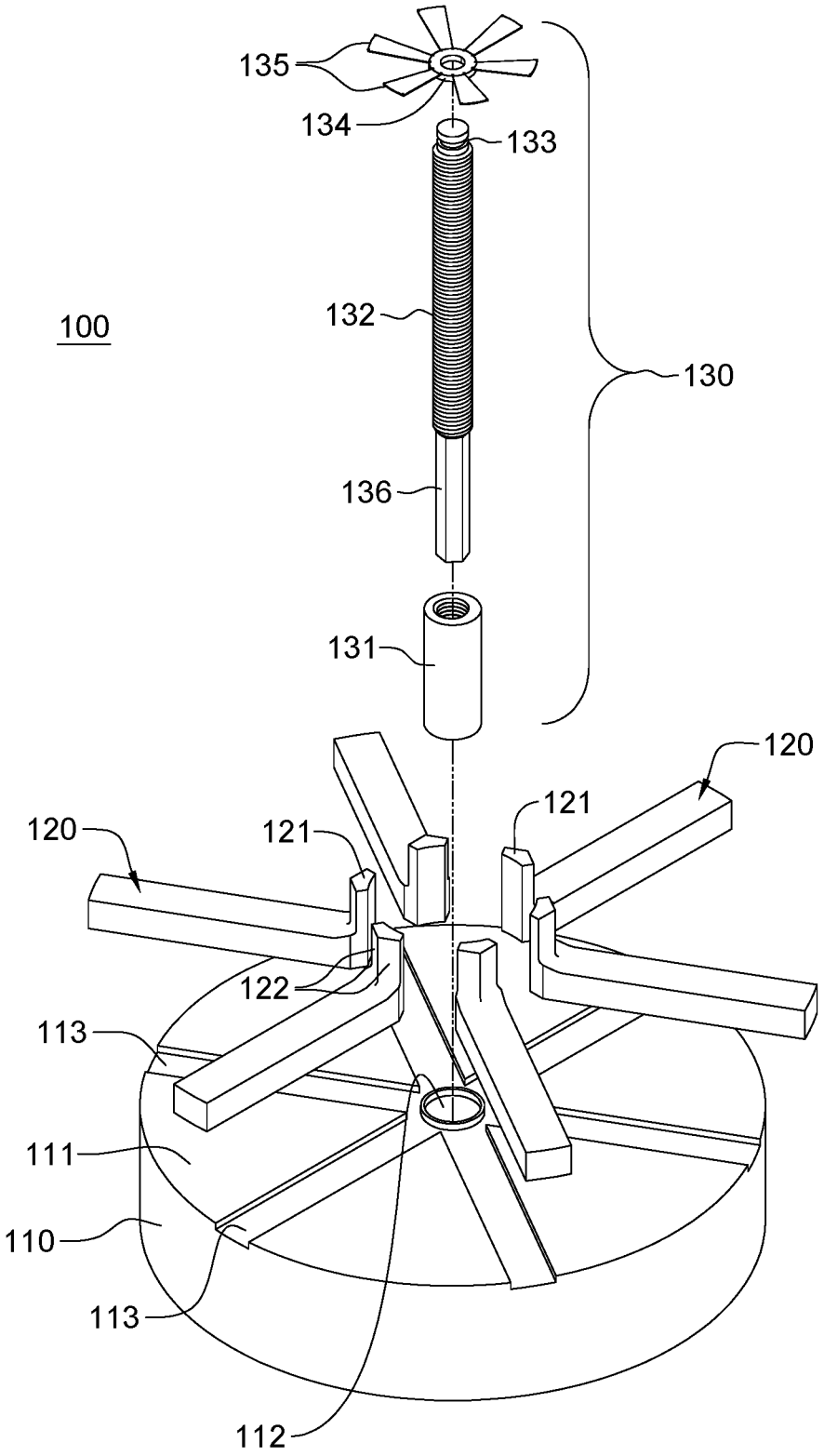
FIG. 1 depicts a partially exploded view of one embodiment of an adjustable fastener tool, in accordance with one or more aspects of the present invention.

As a particular example, FIG. 1 depicts an exploded view of one embodiment of a fastener tool 100, in accordance with one or more aspects of the present invention. In the embodiment shown, fastener tool 100 includes a support member 110, multiple engagement fingers 120 and an adjustment mechanism 130. As an example, support member 110 is shown as a cylindrical support member having a surface 111 with multiple radially-extending tracks 113 and a central opening 112, which may extend through support member 110. As shown, multiple radially-extending tracks 113 may be respective channels or grooves in surface 111 of support member 110. Alternatively, other types of tracks may be provided in association with support member 110 configured to allow for radial movement of the respective fingers 120. An example of one such alternate configuration is shown in FIG. 5, and described below.

As illustrated in FIG. 1, in one or more embodiments, each engagement finger 120 may be identically formed and include an elongate body which is restrained by or within, and reciprocates within or along a respective radially-extending track 113 of support member 110. Each engagement finger 120 includes at a radially inner end a jaw 121 configured and sized to extend into an opening or recess in a socket head of a specific type of fastener to be engaged. In particular, outer facing surfaces of jaws 121 are configured as contact surfaces 122 to mateably engage with an inner wall of a socket head recess, including (for instance) a corner in the inner wall of the socket head recess (as shown in the example of FIG. 4). Note also that the support member 110 and multiple engagement fingers 120 may be formed of any appropriate, rigid material, such as a metal or metal alloy.

In the embodiment of FIG. 1, adjustment mechanism 130 includes a cylinder 131 sized to reside in, and be secured within, central opening 112 in support member 110. Cylinder 131 may be internally threaded to threadably receive a threaded central shaft 132, of an actuating member of the adjustment mechanism 130. The actuating member may include central shaft 132 and a truss support member 134, such as a truss affixment ring, held by central shaft 132. As one example, truss support member 134 may reside, at least in part, within a circumferential groove 133 in central shaft 132 of adjustment mechanism 130. Multiple hinged trusses 135 are hingedly coupled at one end to truss support member 134, and as illustrated below with reference to FIGS. 2A-3C, hingedly coupled at another (opposite) end to a respective engagement finger 120 of the multiple engagement fingers. In this manner, linear movement of the actuating member, including central shaft 132 and truss support member 134, results in radial movement of the respective engagement fingers 120 along their associated radially-extending tracks 113 of support member 110. More particularly, as central shaft 132 is rotated and extended, the truss support member 134 moves linearly, transferring force to the hinged trusses 135 uniformly, and in turn to the engagement fingers 120, which will slide radially relative to a center axis of the fastener tool (e.g., passing through central shaft 132).

As shown in FIG. 1, the opposite end of central shaft 132 may be configured for engagement by a drive mechanism. For instance, in the embodiment illustrated a hexagonal-shaped cut 136 is provided in the lower section of central shaft 132. This allows, for instance, a knob to be attached that allows for adjustment of the adjustable fastener tool. When locked in place, the hexagonal-shaped cut 136 could also be used to turn the fastener tool by, for instance, a wrench or socket wrench with an appropriately sized socket. If used with a robotic or automated assembly tool, the central shaft 132 could be coupled to an external stepper motor and brake to actuate and lock the shaft in an automated manner.

Figure 2A:
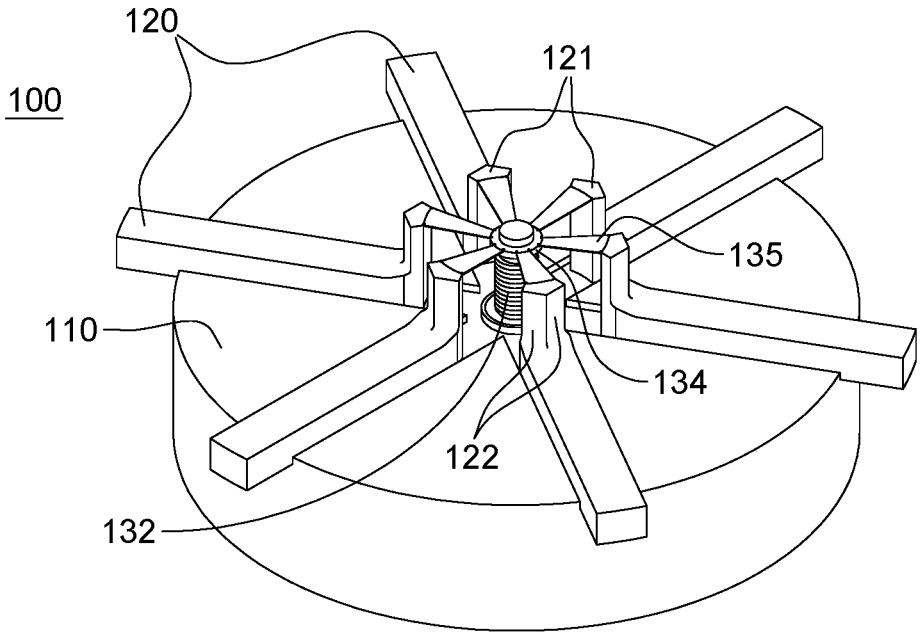
FIG. 2A is an assembled view of the adjustable fastener tool embodiment of FIG. 1, shown with the jaws in an extended position, in accordance with one or more aspects of the present invention.
Figure 2B:
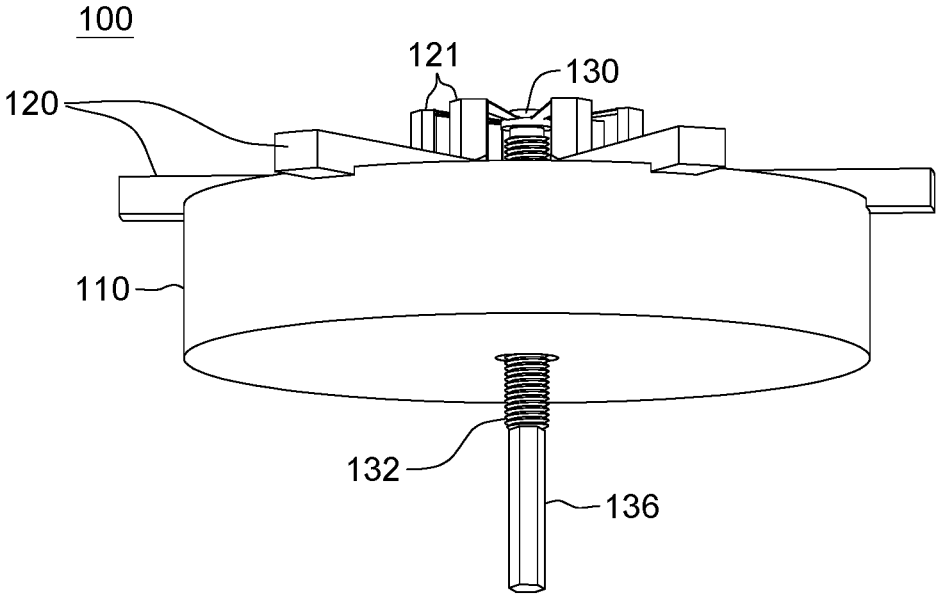
FIG. 2B depicts an underside view of the adjustable fastener tool embodiment of FIG. 2A, with the jaws in the extended position, in accordance with one or more aspects of the present invention.
Figure 2C:
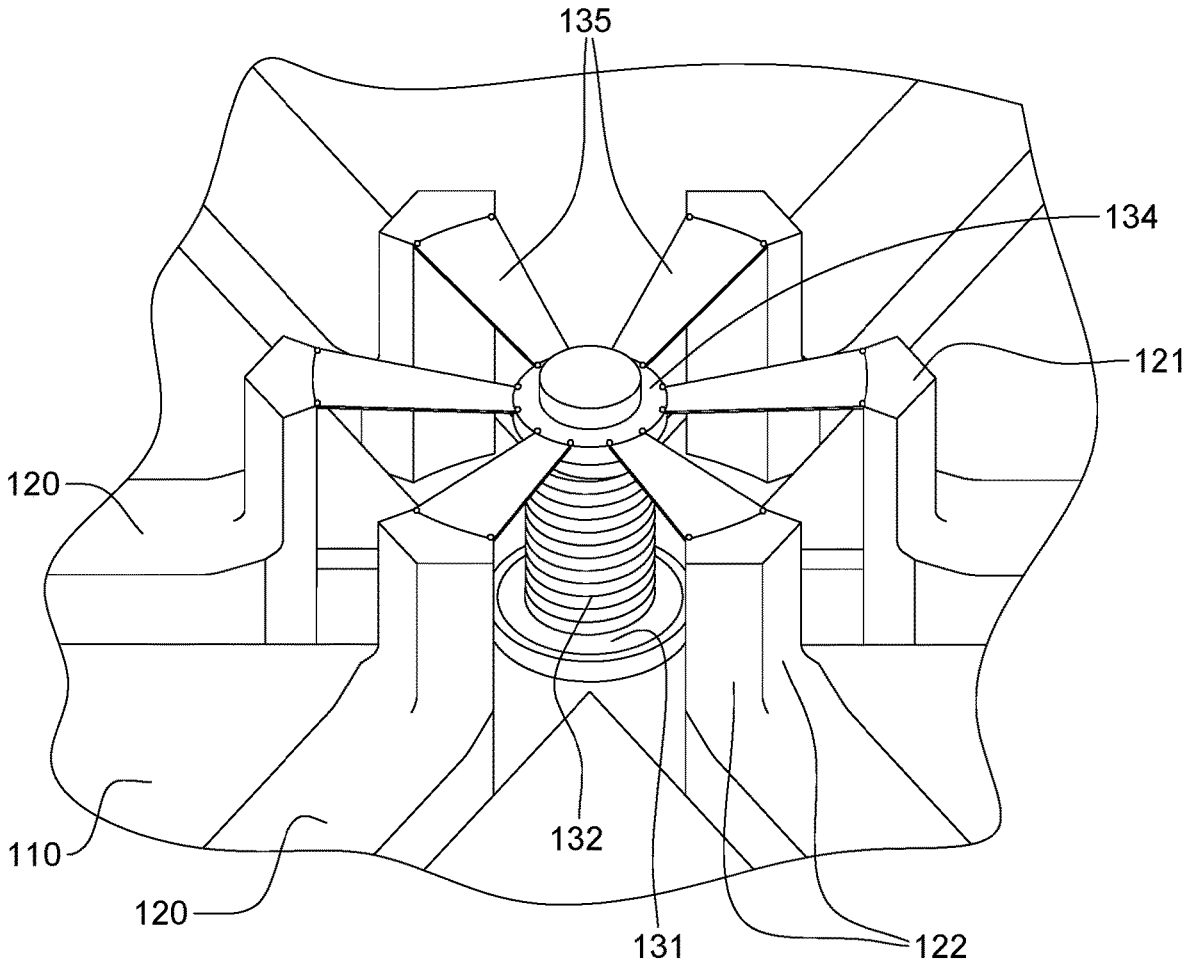
FIG. 2C is an enlarged depiction of the jaws and adjustment mechanism of the adjusted fastener tool embodiment of FIG. 2A, in the extended position, in accordance with one or more aspects of the present invention.

FIGS. 2A-2C depict an assembled view of fastener tool 100 of FIG. 1, with jaws 121 of fastener tool 100 shown in an extended position, that is, with jaws 121 in an outer most position of the embodiment depicted. Referring collectively to FIGS. 2A-2C, engagement fingers 120 are shown in the respective radially-extending tracks of support member 110, and adjustment mechanism 130 is shown extending, in part, through the central opening in support member 110. In particular, the internally threaded cylinder 131 may be secured within the central opening and the threaded central shaft 132 may extend through the internally threaded cylinder 131, such that truss support member 134 is shown in extended position above support member 110 with, for instance, the multiple hinged trusses 135 extending substantially horizontally in this embodiment between truss support member 134 and the respective jaws 121 of engagement fingers 120. Note also that, in the embodiment depicted, the lowermost, cut end of threaded central shaft 132 extends out past the underside of support member 110 to allow, for instance, for an appropriate turning or drive mechanism to couple to fastener tool 100, as noted above. In the embodiment of FIGS. 2A-2C, the fastener tool, and in particular, the jaws of the fastener tool are shown in an outer-most, extended position such that the contact surfaces 122 of jaws 121 may engage, in this example, a largest-sized hex-shaped opening of a hex socket head to be gripped or engaged by the fastener tool.

Figure 3A:
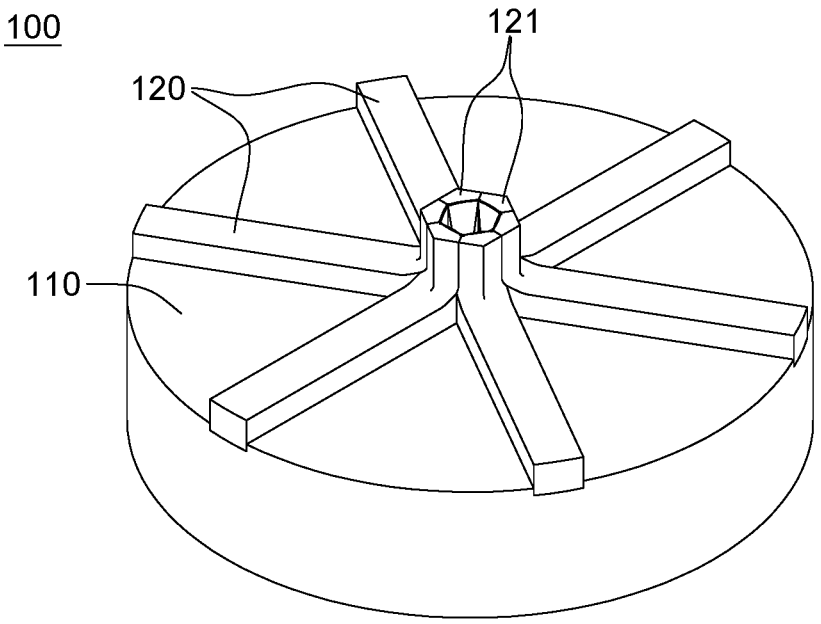
FIG. 3A depicts the adjustable fastener tool embodiment of FIGS. 1-2C, with the jaws shown in a contracted position, in accordance with one or more aspects of the present invention.
Figure 3B:
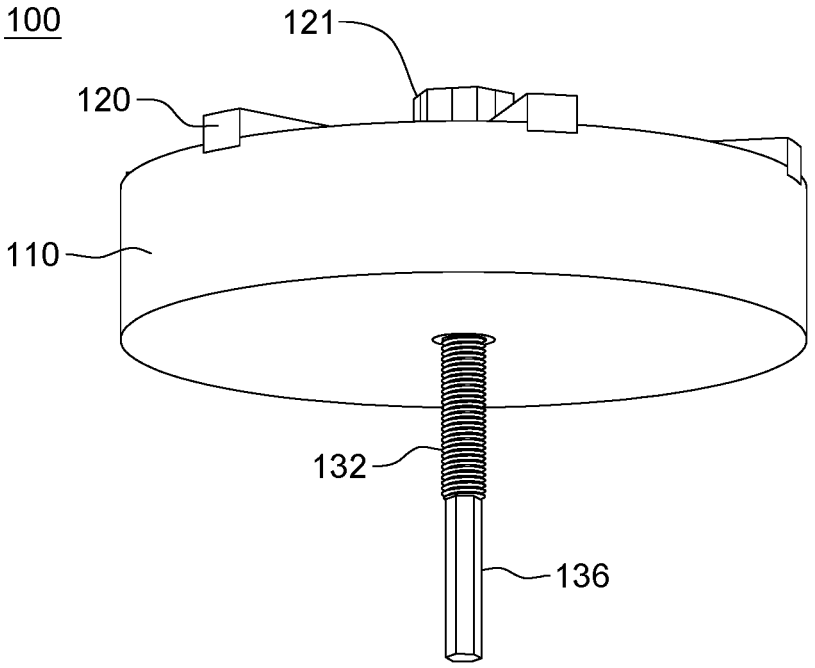
FIG. 3B depicts an underside view of the adjustable fastener tool embodiment of FIG. 3A, with the jaws in the contracted position, in accordance with one or more aspects of the present invention.
Figure 3C:
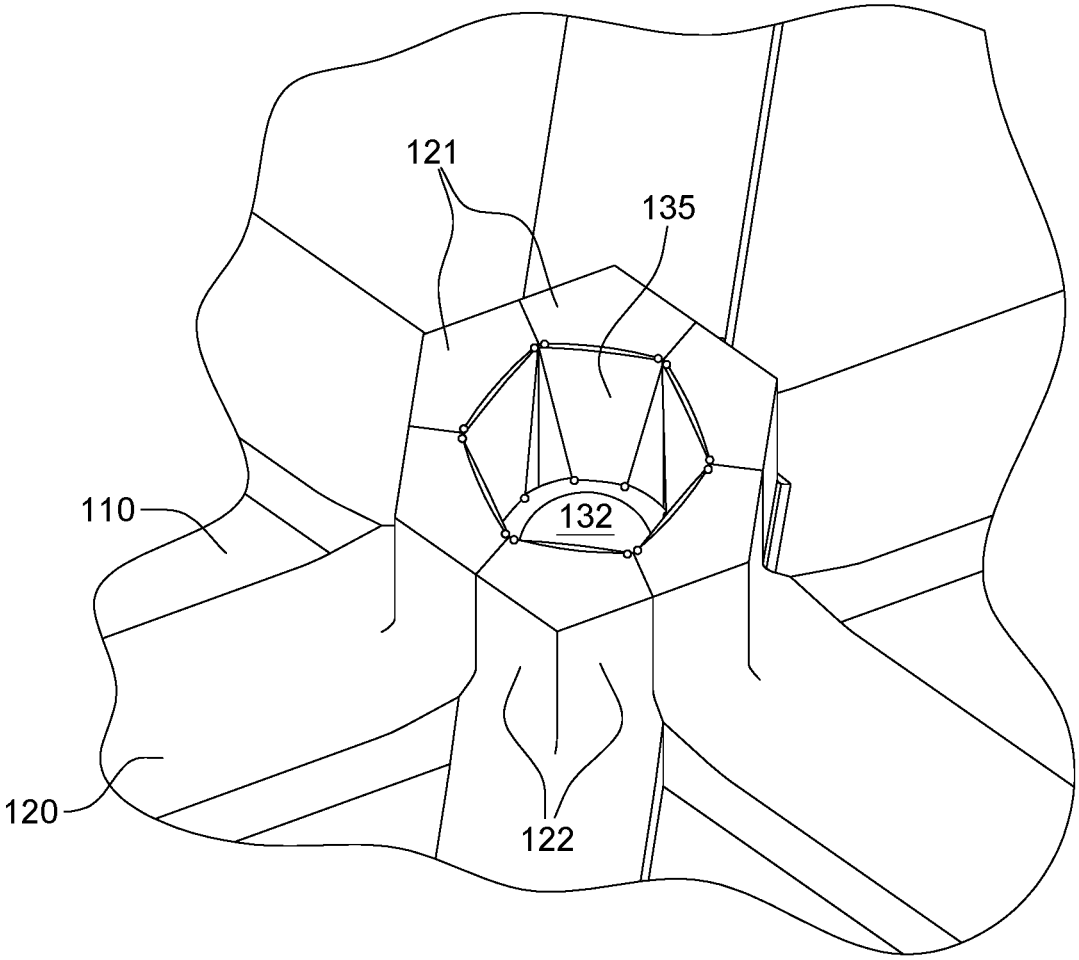
FIG. 3C is an enlarged depiction of the jaws and adjustment mechanism of the adjustable fastener tool embodiment of FIG. 3A, in the contracted position, in accordance with one or more aspects of the present invention.

FIGS. 3A-3C depict similar respective views to those of FIGS. 2A-2C, but with jaws 121 of fastener tool 100, shown in a contracted position for engaging, for instance, a smallest-sized hex-shaped opening in a hex socket head to be engaged by the fastener tool. Note that in FIGS. 3A-3C, jaws 121 of engagement fingers 120 physically contact (in one embodiment) along their sides in the contracted position, and with the threaded central shaft 132 now drawn further down through support member 110. To contract the jaws to the position illustrated, the threaded central shaft 132 may be threadably moved along its axis by rotation through the internally threaded cylinder within support member 110, which moves the truss support member and the hinged trusses downward, drawing the engagement fingers 120 and jaws 121 inward into contact as illustrated. In the embodiment shown, in this contracted position, hinged trusses 135 may be oriented substantially vertical, and reside against the ends of engagement fingers 120 (as shown in FIG. 3C).

Those skilled in the art will note from the above discussion that provided herein are adjustable fastener tools for engaging various-sized socket heads of a particular type. The adjustable fastener tool includes a support member with a central opening and multiple radially-extending tracks, as well as multiple engagement fingers. The multiple engagement fingers are associated with, and slidable along respective radially-extending tracks of the multiple radially-extending tracks of the support member. The multiple engagement fingers include at radially inner ends thereof jaws with respective contact surfaces for engaging the socket head when the adjustable fastener tool is used to engage the socket head. Additionally, the fastener tool includes an adjustment mechanism residing, at least in part, within the central opening of the support member, and coupled to the multiple engagement fingers. The adjustment mechanism facilitates adjusting location of the multiple engagement fingers, and thereby the jaws, along the multiple radially-extending tracks. The adjustment mechanism may include an actuating member, and multiple hinged trusses. A hinged truss of the multiple hinged trusses may be hingedly coupled at one end to the actuating member and hingedly coupled at an other end to a respective engagement finger of the multiple engagement fingers. Movement of the actuating member advantageously results, via the hinged truss, in slidable movement of the respective engagement finger along its associated radially-extending track.

In one or more implementations, the actuating member includes a central shaft, such as a threaded central shaft, and a truss support member. The central shaft supports the truss support member, and each hinged truss of the multiple hinged trusses is hingedly coupled at one end to the truss support member, and hingedly coupled at an other end to a respective engagement finger of the multiple engagement fingers. Linear movement of the truss support member (along a central axis of the tool) results in radial movement of the multiple engagement fingers along the multiple tracks. The central shaft may be threadably adjustable relative to the support member. For instance, the support member may include internal threads within the central opening, or may include a cylinder with internal threads disposed within the central opening. In one or more embodiments, the truss support member may reside, in part, within a circumferential groove in the central shaft of the actuating member. For instance, the truss support member may be an affixment ring rotatably held, in part, within the circumferential groove in the central shaft. In this manner, the multiple hinged trusses are advantageously in continuous contact with the multiple engagement fingers during an expansion of the jaws and during a contraction of the jaws via the adjustment mechanism.

In one or more embodiments, the multiple radially-extending tracks of the support member may be, or may include, multiple radially-extending channels in a surface of the support member. Further, the multiple radially-extending tracks of the support member may each constrain a respective engagement finger, of the multiple engagement fingers, to radial movement during an expansion or contraction of the jaws between contracted and expanded positions. Advantageously, the multiple engagement fingers may be infinitely adjustable during expansion or contraction of the jaws between the contracted and expanded positions. As noted, linear movement of the actuating member is translated via, in part, the multiple hinged trusses, into radial movement of the multiple engagement fingers along the multiple radially-extending tracks of the support member. In one or more implementations, the jaws at the inner ends of the engagement fingers each include a contact surface to mate to a surface of the opening or recess in the socket head to be engaged, including (for instance) a corner in the opening of the socket head.

As illustrated in the figures, in one or more implementations, the support member of the adjustable fastener tool may be packaged as a cylinder for engagement by, for instance, a powered drive mechanism, or an unpowered drive mechanism, such as a handheld tool. An example of this is depicted in FIG. 4, where a fastener tool assembly 400 is shown as including fastener tool 100 received within, for instance, a chuck of a drive mechanism 410, which may include appropriate gearing 411 and a control mechanism 412 to allow for manual or automated control of the position of the jaws of the fastener tool between the contracted and expanded positions. By way of example, the fastener tool assembly 400 of FIG. 4 is shown being brought into engagement with a socket head fastener 401, which in the example depicted includes a hex-shaped opening or recess 402. As noted above, each jaw of the fastener tool may be configured to engage a respective corner in hex-shaped opening 402 of the socket head fastener 401 to be engaged by the tool.

In one or more implementations, a shaft collar clamp, such as available from W.W. Grainger, Inc. of Lake Forest, Ill., U.S., may be employed in association with the adjustable fastener tool. The shaft collar clamp may be associated with or affixed to the body of the tool, such as the support member, and be locked in place about the actuation shaft in order to, for instance, prevent rotation of the shaft during use of the fastener tool to turn a socket head fastener.

By way of further example, FIG. 5 depicts an example of a further embodiment of a fastener tool 100' for engaging, for instance, hex-type socket heads of various sizes. As shown, fastener tool 100' is similar to the fastener tool 100 embodiment of FIGS. 1-3C, with the exception of the multiple radially-extending tracks and the engagement fingers. In particular, fastener tool 100' includes multiple engagement fingers 120', each of which has an inverted, t-shaped member 500 depending from a lower surface thereof sized and positioned to reside within a respective inverted t-shaped channel 113' within support member 110. Depending on the finger-to-track coupling method used in the embodiment FIGS. 1-3C, the fastener tool embodiment of FIG. 5 may provide enhanced coupling of the engagement fingers 120' with the radially-extending tracks 113' during, for instance, use of the fastener tool to tighten or loosen a respective socket head fastener.

As noted, the adjustable fastener tool may be packaged in (for instance) a cylindrical configuration, such as depicted in FIGS. 1-5, and feature sliding engagement fingers. In a hex implementation, six sliding fingers with a 60° pitch may be provided to fit into the corners in the opening of a hex head fastener. In one or more other implementations, a differing number of fingers could be provided, as well as different contact surface configurations as desired to mate to a particular type of socket head fastener. For instance, four engagement fingers 120" (FIG. 6) could be used in an implementation of a square socket head fastener 100". In FIG. 6, an adjustable fastener tool 100", similar to fastener tool 100 described above in connection with FIGS. 1-4, is depicted, with the exception that the number and location of the radially-extending tracks 113 of the support member, and the number and configuration of the engagement fingers is modified to engage a square socket head. In this example the four engagement fingers are provided at a 90° pitch. Further, note that the jaws 121' are configured to mate to square-type socket head fasteners of a variety of sizes.

Note that the fastener tools disclosed herein may be fitted to drills, socket wrenches, screw drivers, or other machines or tools, and be scaled-to-suit a variety of size ranges as desired. Advantageously, a fastener tool such as disclosed allows for infinite adjustability within a defined range between contracted and expanded positions, allowing the tool to be used, for instance, to assist in extracting socket head bolts that may be out of spec or size, or have partially stripped heads. Further, the infinite adjustability allows for the fastener tool to be used with socket heads of both SAE and metric standards. Alternatively, in one or more other embodiments, presets could be provided for added convenience.

In one or more implementations, the actuating member of the adjustment mechanism may be threaded, and be controlled to drive the engagement fingers in and out equally, as well as provide a strong lock feature, and allow for the above-noted infinite adjustment of the jaws or grippers between the designed contracted and expanded positions. The infinite adjustability of the fastener tool disclosed herein is obtained within the specified range between contracted and expanded positions. Further, in one or more embodiments, the use of pitched fingers or jaws allow the tool to grip the corners of the fastener opening. The fingers are linked together through the truss support member and the hinged trusses. As the inner shaft or cylinder is rotated, it moves the truss support member up and down, which causes, via the hinged trusses, the engagement fingers to move radial out or in. For instance, with an outward expansion of the engagement fingers, via an upward movement of the truss support member, the trusses rotate about, for instance, respective hinges or ball joints, constantly maintaining contact with the engagement fingers.

Advantageously, the adjustable fastener tools disclosed herein can be used to fit a range of fastener sizes, and provide torque across all expandable sizes. The fastener tools disclosed eliminate the need for a search for a correct sized socket or driver and can be used across both metric and SAE fasteners. Further, the disclosed fastener tools can work with out of specification fasteners or partially stripped fasteners. Additionally, the adjustable fastener tools disclosed can be mounted into, for instance, the chuck of a drill or other powered driver, such as a lathe, or other power tool, or be part of an unpowered tool, such as a handheld tool.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the invention for various embodiments with various modifications as are suited to the particular use contemplated.

What is claimed is:

1. An adjustable fastener tool for engaging a socket head, the adjustable fastener tool comprising:

a support member with a central opening passing through a surface of the support member with multiple radially-extending tracks extending radially outward along the surface relative to the central opening;

multiple engagement fingers, the multiple engagement fingers being associated with, and slidable along, the multiple radially-extending tracks of the support member, the multiple engagement fingers including at radially inner ends thereof jaws with respective contact surfaces for engaging the socket head, and the multiple radially-extending tracks of the support member each constrain a respective engagement finger of the multiple engagement fingers to radial movement along the surface of the support member during an expansion of the jaws or a contraction of the jaws between contracted and expanded positions; and an adjustment mechanism residing, at least in part, within the central opening in the support member, and coupled to the multiple engagement fingers, the adjustment mechanism facilitating adjusting location of the multiple engagement fingers, including the jaws, along the multiple radially-extending tracks, and the adjustment mechanism comprising:

an actuating member; and multiple hinged trusses, a hinged truss of the multiple hinged trusses being hingedly coupled at one end to the actuating member and hingedly coupled at an other end to a respective engagement finger of the multiple engagement fingers, wherein movement of the actuating member results, via the hinged truss, in slidable movement of the respective engagement finger along its associated radially-extending track.

2. The adjustable fastener tool of claim 1, wherein the actuating member comprises:

a central shaft; and a truss support member, the central shaft supporting the truss support member, wherein each hinged truss of the multiple hinged trusses is hingedly coupled at one end to the truss support member and hingedly coupled at another end to a respective engagement finger of the multiple engagement fingers, and movement of the truss support member using the central shaft results in a uniform sliding of the multiple engagement fingers along the multiple radially-extending tracks.

3. The adjustable fastener tool of claim 2, wherein the central shaft is threadedly adjustable, and is rotatable without rotating the truss support member.

4. The adjustable fastener tool of claim 3, wherein the truss support member comprises an affixment ring disposed, in part, within a circumferential groove in the central shaft.

5. The adjustable fastener tool of claim 2, wherein the multiple hinged trusses are in continuous contact with the multiple engagement fingers during an expansion of the jaws and during a contraction of the jaws via the adjustment mechanism.

6. The adjustable fastener tool of claim 1, wherein the multiple radially-extending tracks of the support member comprise multiple radially-extending rails disposed in respective channels in the surface of the support member.

7. The adjustable fastener tool of claim 6, wherein a location of the multiple engagement fingers is infinitely adjustable during expansion or contraction of the jaws between the contracted and the expanded positions of the jaws.

8. The adjustable fastener tool of claim 1, wherein linear movement of the actuating member is translated via, in part, the multiple hinged trusses into radial movement of the multiple engagement fingers along the multiple radially-extending tracks of the support member.

9. The adjustable fastener tool of claim 1, wherein the jaw at the radially inner end of an engagement finger of the multiple engagement fingers comprises a contact surface to mate to a corner in an opening of the socket head.

10. A combination comprising:

an adjustable fastener tool for engaging a socket, the adjustable fastener tool comprising:

a support member with a central opening passing through a surface of the support member with multiple radially-extending tracks extending radially outward along the surface relative to the central opening;

multiple engagement fingers, the multiple engagement fingers being associated with, and slidable along, the multiple radially-extending tracks of the support member, the multiple engagement fingers including at radially inner ends thereof jaws with respective contact surfaces for engaging the socket head, and the multiple radially-extending tracks of the support member each constrain a respective engagement finger of the multiple engagement fingers to radial movement along the surface of the support member during an expansion of the jaws or a contraction of the jaws between contracted and expanded positions; and an adjustment mechanism residing, at least in part, within the central opening in the support member, and coupled to the multiple engagement fingers, the adjustment mechanism facilitating adjusting location of the multiple engagement fingers, including the jaws, along the multiple radially-extending tracks, and the adjustment mechanism comprising:

an actuating member;

multiple hinged trusses, a hinged truss of the multiple hinged trusses being hingedly coupled at one end to the actuating member and hingedly coupled at an other end to a respective engagement finger of the multiple engagement fingers, wherein movement of the actuating member results, via the hinged truss, in slidable movement of the respective engagement finger along its associated radially-extending track; and a drive mechanism coupled to the support member for imparting a force to the adjustable fastener tool when engaging the socket head.

11. The combination of claim 10, wherein the drive mechanism is a power tool drive mechanism.

12. The combination of claim 10, wherein the drive mechanism is a manual drive and the adjustable fastener tool is a handheld tool.

13. The combination of claim 10, wherein the actuating member comprises:

a central shaft; and a truss support member, the central shaft supporting the truss support member, wherein each hinged truss of the multiple hinged trusses is hingedly coupled at one end to the truss support member and hingedly coupled at another end to a respective engagement finger of the multiple engagement fingers, and movement of the truss support member using the central shaft results in a uniform sliding of the multiple engagement fingers along the multiple radially-extending tracks.

14. The combination of claim 13, wherein the central shaft is threadedly adjustable, and is rotatable without rotating the truss support member.

15. The combination of claim 14, wherein the truss support member comprises an affixment ring disposed, in part, within a circumferential groove in the central shaft.

16. The combination of claim 13, wherein the multiple hinged trusses are in continuous contact with the multiple engagement fingers during an expansion of the jaws and during a contraction of the jaws via the adjustment mechanism.

17. The combination of claim 10, wherein the multiple radially-extending tracks of the support member comprise multiple radially-extending rails disposed in respective channels in the surface of the support member.

18. The combination of claim 17, wherein a location of the multiple engagement fingers is infinitely adjustable during expansion or contraction of the jaws between the contracted and the expanded positions of the jaws.

19. A method of fabricating an adjustable fastener tool for engaging a socket head, the method comprising:

providing a support member with a central opening in a surface of the support member with multiple radially-extending tracks extending radially outward along the surface relative to the central opening;

providing multiple engagement fingers, the multiple engagement fingers being associated with, and slidable along, the multiple radially-extending tracks of the support member, the multiple engagement fingers including at radially inner ends thereof jaws with respective contact surfaces for engaging the socket head, and the multiple radially-extending tracks of the support member each constrain a respective engagement finger of the multiple engagement fingers to radial movement along the surface of the support member during an expansion of the jaws or a contraction of the jaws between contracted and expanded positions; and providing an adjustment mechanism residing, at least in part, within the central opening in the support member, and coupled to the multiple engagement fingers, the adjustment mechanism facilitating adjusting location of the multiple engagement fingers, including the jaws, along the multiple radially-extending tracks, and the adjustment mechanism comprising:

an actuating member; and multiple hinged trusses, a hinged truss of the multiple hinged trusses being hingedly coupled at one end to the actuating member and hingedly coupled at an other end to a respective engagement finger of the multiple engagement fingers, wherein movement of the actuating member results, via the hinged truss, in slidable movement of the respective engagement finger along its associated radially-extending track.

20. The method tool of claim 19, wherein the actuating member comprises:

a central shaft; and a truss support member, the central shaft supporting the truss support member, wherein each hinged truss of the multiple hinged trusses is hingedly coupled at one end to the truss support member and hingedly coupled at another end to a respective engagement finger of the multiple engagement fingers, and movement of the truss support member using the central shaft results in a uniform sliding of the multiple engagement fingers along the multiple radially-extending tracks.

* * * * *